United States Patent [19]

Kitik et al.

[11] 4,287,400

[45] Sep. 1, 1981

[54] WATER-RESISTANT ROCKER SWITCH

[75] Inventors: Walter Kitik, Wolcott; Rodney Reder, Waterbury; Stanley Kurpiewski, Newington, all of Conn.

[73] Assignee: Timex Corporation, Waterbury, Conn.

[21] Appl. No.: 90,203

[22] Filed: Nov. 1, 1979

[51] Int. Cl.[3] ..... H01H 9/04

[52] U.S. Cl. ..... 200/302; 368/289; 368/291

[58] Field of Search ..... 200/302, 339, 304, 44, 200/321; 368/289, 291, 320, 321, 288, 290

[56] References Cited

U.S. PATENT DOCUMENTS

| | | | |
|---|---|---|---|
| 2,726,105 | 12/1955 | Koenig | 200/302 |
| 2,857,485 | 10/1958 | Brooks | 200/302 |
| 3,483,345 | 12/1969 | Hults | 200/302 |
| 3,973,099 | 8/1976 | Morris, Sr. | 200/159 |

*Primary Examiner*—Willis Little

*Attorney, Agent, or Firm*—William C. Crutcher

[57] ABSTRACT

A rocker switch for actuation from outside the bezel or case of a watertight wristwatch employs a rocker arm making contact with the bezel through its pivot pin and having a stem for contacting internal terminals. The handle of the rocker arm is imbedded in adhesive elastomer which is also adhered to the bezel to provide spring action and a water-resistant seal.

4 Claims, 7 Drawing Figures

WATER-RESISTANT ROCKER SWITCH

BACKGROUND OF THE INVENTION

This invention relates generally to electrical water-resistant switches useful in timepieces which require external pushbuttons or switches to perform various functions such as setting, updating or changing the mode of operation of the timepiece. More particularly, this invention relates to an improved water-resistant rocker switch for a wristwatch which can be used under water by divers, but which is also generally usable in water-resistant watches of all types.

The provision of water-resistant seals for members such as watch crowns or pushbuttons operating internal mechanisms from the exterior of a timepiece have been known for many years. Generally the problem is to allow for sliding or rotary movement of a stem extending through a hole in the bezel without allowing leakage. Many types of gasket and seal arrangements have been suggested in the prior art.

In electric or digital watches, the watchcase or bezel is often at ground potential and a grounded pushbutton makes contact with switching terminals located inside the case. A typical arrangement is shown in U.S. Pat. No. 4,031,348 in the name of N. Eberhardt issued June 21, 1977, wherein a resilient sealing member for a pushbutton assembly in a watch serves as a spring member and also may be conductive to assure electrical contact between the pushbutton member and the watchcase. Unless conductive elastomers are used, some means of providing electrical contact between the moving member and the case is necessary.

A water-resistant pushbutton switch for a watch utilizing an adhesive conductive elastomer to provide a water-resistant seal providing spring return of an external pushbutton making switching contact inside the watch is also illustrated in U.S. Pat. No. 3,973,099 issued to James Morris, Sr. On Aug. 3, 1976. This patent requires a conductive elastomer to provide grounding contact between the pushbutton and the case. Another type of seal is shown in U.S. Pat. No. 3,946,182 issued to P. Holder on Mar. 23, 1976 employing a flexible insulating diaphragm member as a seal and requiring a large number of parts in the assembly. Other types of switches utilizing springs and sliding O-rings are illustrated in U.S. Pat. No. 3,783,607 issued to Walter Feurer on Jan. 8, 1974 and U.S. Pat. No. 3,838,568 issued to Zurcher et. al. on Oct. 1, 1974.

The foregoing constructions which employ conductive elastomers are subject to difficulties with making the proper electrical connections, while switches depending upon sliding metallic contacts are subject to leakage problems. Furthermore, if the timepiece is to be truly capable of withstanding pressure under water, it must employ a construction which is not subject to actuation by large pressure difference between the inside and the outside of the watchcase.

Accordingly, one object of the present invention is to provide an improved water-resistant rocker switch for a timepiece.

Another object of the invention is to provide an improved switch for a watch which is not subject to actuation by water pressure.

Another object of the invention is to provide an improved rocker switch for a timepiece providing improved electrical contact and resistance to leakage.

DRAWING

The invention, both as to organization and method of practice, together with further objects and advantages thereof, will best be understood by reference to the following description, taken in connection with the accompanying drawings, in which:

FIG. 1 is a plan view of portions of a watch bezel, partly in section, illustrating the improved rocker switch assembly, FIGS. 2 and 3 are plan and side views respectively of the internal switch contact assembly, FIG. 4 is an exploded perspective drawing of the rocker arm contact lever assembly, and FIGS. 5, 6 and 7 are plan, elevation, and back views respectively of a wristwatch bezel with two rocker switches, one having a safety guard.

SUMMARY OF THE INVENTION

Briefly stated, the invention is practiced by providing a conductive case member with a bore therethrough, rocker arm with pivot pin, and having a contact stem adapted to make contact with internal terminals insulated from the case member, portions of the lever being embedded in adhesive elastomer filling portions of the space between the lever and the case. Electrical contact with the case is maintained via the pivot pin and may be assisted by a washer member which also supports the elastomer.

DESCRIPTION OF THE PREFERRED EMBODIMENT

Figure 1:
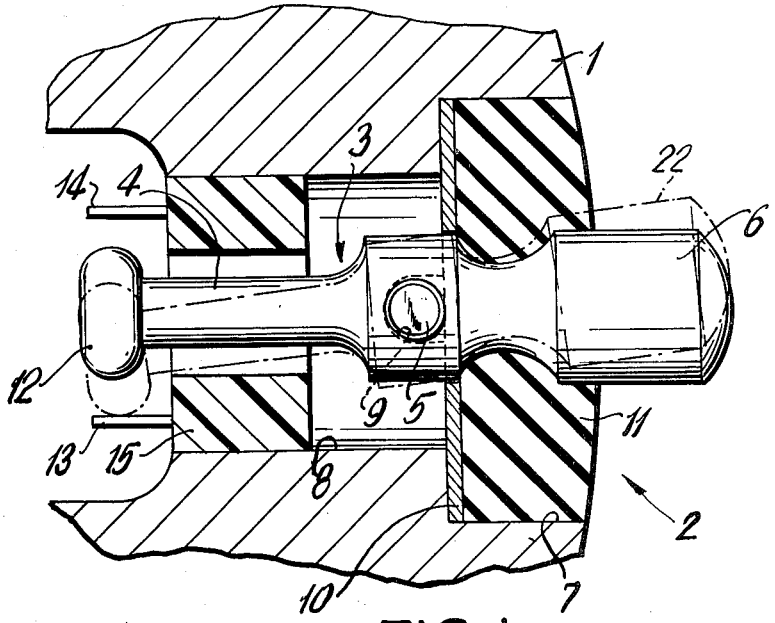

Referring now to FIG. 1 of the drawing, a watch bezel or case 1 for an electric watch is adapted to receive the improved rocker switch assembly shown generally as 2. The switch assembly is comprised of a pivoting rocker arm shown generally as 3 having a contact stem portion 4, a pivot pin 5, and an actuating handle 6. The handle 6 is disposed in a larger bore 7 in the bezel which connects with a smaller bore 8. The ends of pivot pin 5 rest in slots 9 milled in the wall of the smaller bore 8. A metal washer 10 separates the large bore 7 from the small bore 8 and the large bore 7 is filled with an adhesive elastomer 11.

The contact stem portion 4 of the contact lever includes a terminating contact knob 12 disposed to make contact with either of two metallic switch terminals 13 and 14. Terminals 13 and 14 are held in a plug 15 of insulating material in the end of the bore 8.

Figure 2:
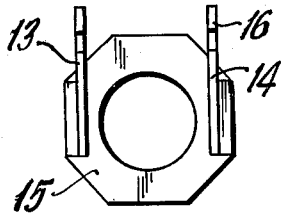
Figure 3:
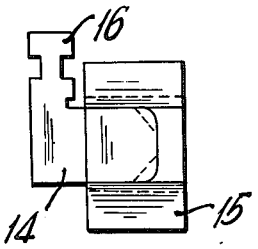

Reference to FIGS. 2 and 3 of the drawing shows that the plug comprises a hexagonal washer member of material such as Micarta (Registered Trademark of Westinghouse Electric Corp.) having the contact terminals 13 and 14 adhered thereto by epoxy and electrically connected by means of tabs 16 to portions of the watch circuit (not shown).

Figure 4:
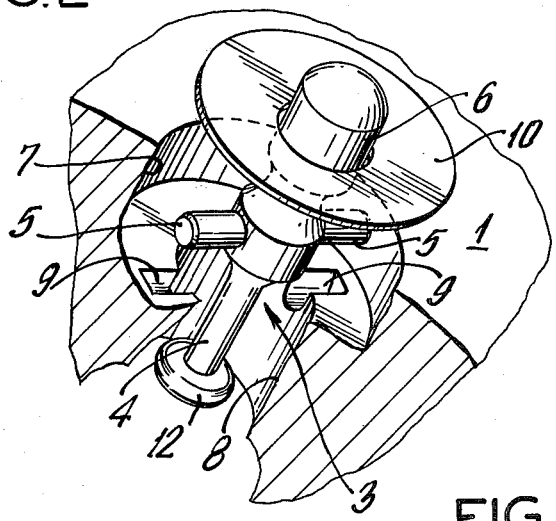

The perspective exploded view of FIG. 4 illustrates the rocker arm 3 and illustrates how the pivot pin 5 is disposed to nest in grooves 9 so that the lever can perform a pivot or toggle action when the actuator handle 6 is pushed. Metallic or grounding contact is further assured by washer 10 and pivot pins 5 contacting the watch bezel 1.

The seal is provided by the adhesive elastomer 11 filling the bore 7 and supported by washer 10. The elastomer is not required to be conductive, although, of course a conductive elastomer may be used. A suitable material is known as Flexane 80SF obtained from Devcon Corp., Danvers, Mass., applied with a suitable primer so as to adhere both to the bezel and to the actuator handle.

Figure 5:
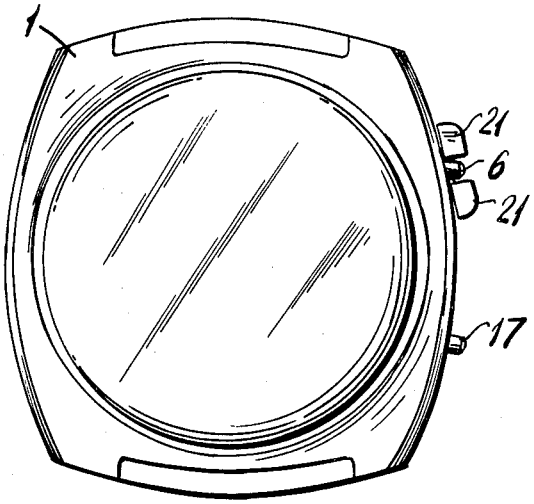
Figure 6:
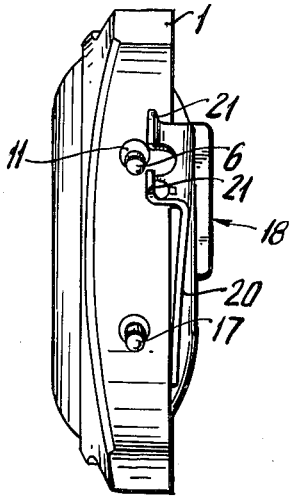
Figure 7:
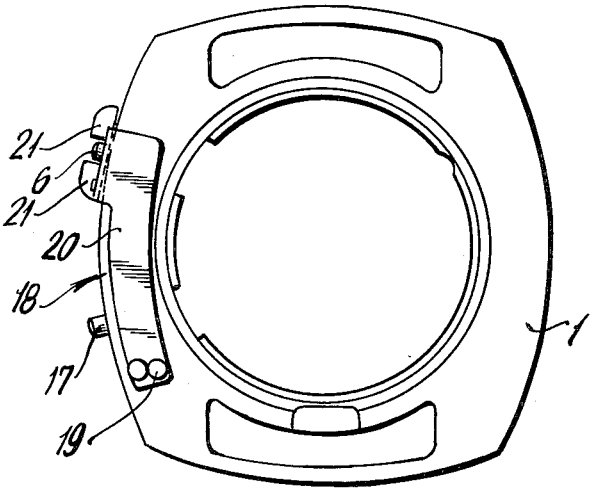

Referring to FIGS. 5, 6 and 7 of the drawing, a typical application of the improved rocker switch is illustrated in a diverse wristwatch. Two of the rocker switch assemblies similar to the one illustrated in FIG. 1 are shown, each having an actuator lever 6 and 17 respectively protruding from watch bezel 1. The bezel may incorporate a guard member 18 attached to the back by screws 19. The guard 18 includes a springy arm 20 having two tabs 21 which are positioned by spring action on either side of the actuator handle 6 when it is in the center position, so that the handle 6 cannot be operated inadvertently. To operate the handle 6, the tabs 21 are pushed to the side and then the handle 6 can be actuated as illustrated in FIG. 6 of the drawing.

OPERATION

Referring back to FIG. 1 of the drawing, the operation of the invention will be apparent. Movement of the actuator lever 6 is possible in either of two directions, as illustrated by the phantom lines 22, the pivoting action taking place on the axis of pin 5 and permitted by elastomer 11. Pivoting causes the contact end of stem 4 to make electrical contact with switch terminal 13. Electrical contact is maintained to the case via pin 5 resting in groove 9 and also by the washer 10. Movement of the handle increases the pressure on the pin and also on the washer to assure a good grounding contact to the case.

It remains to note that a pressure difference across the bezel 1 when imposed on the elastomer 11 is resisted by the support of washer 10 and also by pin 5 in groove 9. Thus, the improved switch assembly is able to withstand considerable pressure difference and not become actuated accidentally as would be the case with many sliding type pushbuttons which would be actuated by water pressure alone.

Thus, there has been described an improved water-resistant rocker switch assembly while it has been shown particularly in its preferred construction applicable to a timepiece, it is also applicable to any electrical device with a conductive case which may be actuated through a water-resistant switch from outside the device. While there has been disclosed what is considered herein to be the preferred embodiment of the invention, other modifications will occur to those skilled in the art, and it is desired to include in the appended claims all such modifications as fall within the true spirit and scope of the invention.

What is claimed is:

1. An improved water resistant rocker switch comprising:

a water-resistant conductive case member defining a bore therethrough, said bore comprising a larger diameter section toward the outside of the case member and a small diameter section toward the inside of the case member, a rocker arm disposed in said bore having an actuating handle extending on the outside of the case and a contact stem portion extending toward the inside of the case, electrically conductive support means electrically connected with the case member and pivotably supporting the rocker arm in the bore, said support means comprising a pivot pin on the rocker arm having its ends supported in grooves in said smaller diameter section of the bore, an adhesive elastomer filling a portion of the bore between and adhered to the rocker arm and the case member and adapted to provide spring action while sealing and to allow pivoting movement of the arm, and at least one contact terminal insulated from the case member and spaced from the contact stem portion in its normal position and positioned to be contacted by said stem portion when the rocker arm is pivoted by actuation of the actuating handle.

2. An improved water-resistant switch for a timepiece comprising:

a water-resistant conductive watchcase defining a bore therethrough having a first larger diameter section toward the outside of the case and a second smaller diameter section toward the inside of the case, a rocker arm disposed in said bore having an actuating handle extending from the outside of the case, and a contact stem portion extending through the smaller diameter section of the bore, a pivot pin attached to said rocker arm and pivotably supporting the rocker arm coaxially within said bore, said pivot pin resting in grooves defined in the smaller diameter bore section, washer means disposed in the larger bore section covering the pivot pin, an adhesive elastomer filling the larger diameter section around the actuator handle and adhered to the case and actuating handle, insulating plug means disposed in the smaller diameter bore section around the contact stem portion, and at least one contact terminal means held on the insulating plug member and spaced from the stem portion and adapted to be contacted by the stem portion when the actuating handle is moved, whereby electrical contact is made from the case member to the contact terminal.

3. An improved water resistant rocker switch comprising:

a water-resistant conductive case member defining a bore therethrough, said bore including a larger diameter section toward the outside of the case, a rocker arm disposed in said bore having an actuating handle extending on the outside of the case and a contact stem portion extending toward the inside of the case, a washer member disposed around the rocker arm in said larger diameter section, electrically conductive support means electrically connected with the case member and pivotably supporting the rocker arm in the bore, an adhesive elastomer filling said larger diameter section of the bore between and adhered to the actuating handle of the rocker arm and the case member and adapted to provide spring action while sealing and to allow pivoting movement of the arm, and at least one contact terminal insulated from the case member and spaced from the contact stem portion in its normal position and positioned to be contacted by said stem portion when the rocker arm is pivoted by actuation of the actuating handle.

4. An improved water resistant rocker switch comprising:

a water-resistant conductive case member defining a bore therethrough, a rocker arm disposed in said bore having an actuating handle extending on the outside of the case and a contact stem portion extending toward the inside of the case, electrically conductive support means electrically connected with the case member and pivotably supporting the rocker arm in the bore, an adhesive elastomer filling a portion of the bore between and adhered to the rocker arm and the case member and adapted to provide spring action while sealing and to allow pivoting movement of the arm, at least one contact terminal insulated from the case member and spaced from the contact stem portion in its normal position and positioned to be contacted by said stem portion when the rocker arm is pivoted by actuation of the actuating handle, and a guard member spring mounted to said case and having a pair of tabs preventing rocking movement of the actuating handle until said tabs are displaced.

* * * * *